US006640561B2

(12) United States Patent
Roberto

(10) Patent No.: US 6,640,561 B2
(45) Date of Patent: Nov. 4, 2003

(54) CHILLING UNIT WITH "FREE-COOLING", DESIGNED TO OPERATE ALSO WITH VARIABLE FLOW RATE; SYSTEM AND PROCESS

(75) Inventor: Trecate Roberto, Pavia (IT)

(73) Assignee: RC Group S.P.A., Pavia (IT)

( * ) Notice: Subject to any disclaimer, the term of this patent is extended or adjusted under 35 U.S.C. 154(b) by 0 days.

(21) Appl. No.: 10/117,195

(22) Filed: Apr. 8, 2002

(65) Prior Publication Data

US 2003/0188543 A1 Oct. 9, 2003

(51) Int. Cl.[7] ..... F25D 17/06
(52) U.S. Cl. ..... 62/96; 62/434
(58) Field of Search ..... 62/96, 119, 332, 62/333, 434, 406, 311, DIG. 22

(56) References Cited

U.S. PATENT DOCUMENTS

| | | | | |
|---|---|---|---|---|
| 2,104,333 A | | 1/1938 | Rosenblad | |
| 2,930,593 A | * | 3/1960 | Blum | 165/220 |
| 4,869,071 A | | 9/1989 | Wehner et al. | |
| 4,932,221 A | | 6/1990 | Shimizu et al. | |
| 5,097,669 A | | 3/1992 | Hargrove et al. | |
| 5,797,275 A | * | 8/1998 | Forsman | 62/175 |
| 5,970,729 A | | 10/1999 | Yamamoto et al. | |

FOREIGN PATENT DOCUMENTS

| | | | |
|---|---|---|---|
| DE | 15 01 874 | | 2/1971 |
| DE | 40 14 435 | | 11/1991 |
| EP | 0 304 189 | | 2/1989 |
| JP | 403093172 A | * | 4/1991 |

* cited by examiner

*Primary Examiner*—Melvin Jones
(74) *Attorney, Agent, or Firm*—Young & Thompson

(57) ABSTRACT

A unit comprises a refrigerating circuit (30), at least part of a primary circuit (110), and connections (151, 152) for a user's circuit (120). The refrigerating circuit comprises an evaporator (E), a compressor (31), a condenser battery (C), and an expansion valve (34), and connection lines. The primary circuit extends through the evaporator and through an air-cooled "free-cooling" battery (FC). To allow a variable flow through the free-cooling battery, though maintaining the flow rate constant through the evaporator, the primary circuit (110) comprises a bypass line (140) extending between an outlet line from the evaporator and an inlet line to the evaporator, and a storage tank (A) on said bypass line.

8 Claims, 3 Drawing Sheets

CHILLING UNIT WITH "FREE-COOLING", DESIGNED TO OPERATE ALSO WITH VARIABLE FLOW RATE; SYSTEM AND PROCESS

DESCRIPTION

The present invention refers to the field of refrigerating or chilling systems of the so-called "free-cooling" type.

Refrigerators or chillers with free-cooling are currently available on the market and are generally used for technological sites (data banks, telephone exchanges, etc.). There follows a brief explanation with reference to FIG. 1, which shows a currently known typical free-cooling system. The system is designated as a whole by reference number 1 and comprises a primary circuit 10, a secondary or user's circuit 20, and a refrigerating or cooling circuit 30. The refrigerating circuit comprises a compressor 31, a condenser or condenser battery C, an expansion valve 34, and an evaporator E. It further comprises a line 32 between the compressor and the condenser, a line 33 between the condenser and the expansion valve, a line 35 between the expansion valve and the evaporator, and a line 36 between the evaporator and the compressor, all these being indicated in the figures with dash lines.

The secondary circuit 20 generally comprises a disconnector line referenced 21, a delivery line 22 with pump P2; a number of users' appliances or terminals referenced U, U', each on a respective user's line 23, 23', the lines 23, 23' etc. being generally connected in parallel, and each having a bypass line 25, 25'; and a return line 26.

The primary circuit 10 comprises a free-cooling battery EC, a delivery line 12 at outlet from the evaporator, a return line 13 with pump P1, a bypass line 14 for bypassing the free-cooling battery, said line extending to a three-way valve referenced V, a line 15 extending to the free-cooling battery FC, a line 16 extending between the free-cooling battery FC and the three-way valve, and a line 18 extending between the three-way valve and the evaporator.

The free-cooling battery FC is a finned-tube battery. In the tubes thereof a fluid of the primary circuit (generally water) circulates. Air circulates around the tubes, so as to obtain, if the air temperature allows, a "free" cooling of water. The free-cooling battery FC is generally set upstream of the condenser, with respect to the air flow.

The assembly shown in the box of FIG. 1 and referenced 50 is generally supplied as a single or self-contained apparatus called "refrigerator or chiller with free cooling" or "free-cooling chiller" intended for being connected to the user's circuit.

Free cooling chillers are able to exploit the low temperature of outdoor air for cooling water to be sent to a user's system or secondary circuit 20 and are used in systems that require cooling energy also at low temperatures, as in the case of technological systems. They differ from normal chillers in that the finned battery FC is provided, which operates as an air-water heat exchanger, and is located upstream of the condenser battery C, of the refrigerating circuit 30. Air moved by fans traverses in series, first, the air-water battery FC, and then, the condenser C of the refrigerating circuit.

The purpose of the additional battery FC is to take advantage of a low air temperature for cooling the return water coming from the system before sending it to the evaporator of the machine. In this way, a free cooling is obtained which leads to a saving in terms of electrical energy, in that less compressor work is required.

Free-cooling chillers have, therefore, two different operating regimes: normal operation and free-cooling operation.

Switching from normal operation to free-cooling operation is controlled by a microprocessor control system (not shown): when air temperature at the batteries inlet is lower than water temperature at the unit inlet, the free-cooling system is activated.

Under normal operating conditions, the valve V has the way to the line 14 open and the way to the line 16 closed : the free-cooling battery FC is therefore bypassed or excluded. As soon as air temperature, measured by the probe TA, drops below the return water temperature, measured by probe TW2, the valve V opens the way to the line 16 and closes the way to the line 14. In such a way, the return water is cooled by outdoor air in the additional battery FC before entering the evaporator.

In this way, the consumption of electricity by the compressors is reduced. The purpose of the refrigerator or chiller is to produce refrigerated water at a desired temperature, measured by the probe TW1. Obviously, if water is precooled by the free-cooling battery, the amount of refrigerating energy to be supplied, by means of the compressors, to the evaporator decreases, with consequent reduction in the consumption of electricity.

Free-cooling is said to be partial when water is cooled in part freely by the exchange battery and in part in the evaporator, thanks to the operation of the compressor/s; it is said to be total when the entire refrigerating load is supplied freely by the exchange battery.

The percentage of free-cooling as compared to the total refrigerating load required depends upon outdoor air temperature, upon the refrigerating load required from the system, upon refrigerated water temperature desired at outlet from the refrigerator, and upon water inlet temperature in the free-cooling battery.

FIG. 2 shows, as a function of outdoor air temperature, how the load is divided between the free-cooling battery and the compressors in the case of power (capacity) linearly decreasing with external temperature: 100% at 35° C., 40% at 5° C. The temperature at the delivery side to the system, measured by the probe TW1, is 10° C. In the diagram of FIG. 2, the grey area indicates the power (capacity) from the free-cooling battery.

As may be seen, when outdoor air temperature drops below 13° C., the free-cooling battery starts to supply part of the power required by the system. The entire power is supplied by the free-cooling battery for temperatures below 7° C.

The system described has constant flow rate.

The user's terminals or batteries U, U' in fact, are controlled by three-way valves VU, VU'. At full load, all the water passes through the user's batteries U, U' whilst, as the required power is reduced, an increasingly greater part of the water flow bypasses the user's batteries through the lines 25, 25'. Downstream of the valves VU, VU' however, the flow rate remains constant whatever the load required by the system.

Also known are systems in which the user's terminals U, U' of the system may be controlled with two-way valves which directly choke the flow of water to the user's batteries U. U'. The pump P2 varies the number of revolutions to adapt to the new flow rate of the system. The secondary circuit thus operates with variable flow rate. Systems with variable flow rate are becoming increasingly common because they enable a considerable saving on the pumping expenses and because the cost of regulators or controllers with inverter for the pumps is markedly decreasing.

In known systems the flow rate variation, however, must be limited to the secondary or user's circuit alone and cannot take place in the primary circuit 10, a portion of which passes through the evaporator. The primary circuit, in fact, cannot undergo flow rate variations in operation, because a flow rate variation through the evaporator would lead to failure of the compressor 31. In known systems, it is therefore not possible to use a free-cooling battery with variable flow rate.

In systems with constant flow rate the return temperature measured by probe TW2 of FIG. 1 is directly proportional to the load required by the system. For example, if water leaves the chiller assembly 50 at 10° C., at 100% of the load it returns at 15° C. At 75% of the load, the return temperature drops to 13.7° C.; at 50% it becomes 12.5° C.; at 25% it becomes 11.3° C.; and at zero load, it becomes equal to outlet temperature, i.e., The situation is different in the case of a system with variable flow rate in the secondary circuit. The yield (power output) of a user's battery or terminal decreases at a clearly lower rate in percentage terms with respect to the flow of refrigerated water that passes through it. As an immediate consequence of this, the thermal head (difference in temperature) of water between inlet to and outlet from the user's battery or terminal increases as the flow rate decreases.

In a system with variable flow rate, the thermal head increases continuously as the load decreases, and the system behaves in a manner opposite to that of the system with constant flow rate.

The consequences on the dynamics of the temperatures of the system are immediately deducible. In fact, whilst in the case of a system with constant flow rate the return temperatures decrease as the load decreases, in the case of a system with variable flow rate the said temperatures increase. At 75% of the load, the return temperature becomes 19.3° C. as against the 13.7° C. mentioned previously. At 50% of the load, the return temperature becomes 23.1° C. as against the 12.5° C. of the system with constant flow rate. At 25% of the load, the return temperature becomes 26.3° C. as against 11.3° C. of the system with constant flow rate.

If it were possible to operate the free-cooling battery at a variable flow rate, the advantages would be considerable because this would involve a greater exploitation of the free-cooling battery.

The purpose of the present patent application is therefore, in a free-cooling refrigerating system, to enable operation with variable flow rate also in the part of the primary circuit relating to the free-cooling battery, thus exploiting the possibilities of the free-cooling battery, in the best possible way.

In other words, a new refrigerating unit comprises a traditional refrigerating circuit and a primary free-cooling circuit which has, between the delivery or outlet line from the evaporator, and the entry or inlet line to the evaporator, a bypass line with a storage tank. Preferably, the pump of the primary circuit is mounted on the outlet or delivery line from the evaporator.

When mounted in a system with user's appliances requiring a variable flow rate, the new chilling unit enables a variable flow rate not only in the user's circuit but also in the part of the primary circuit that passes through the free-cooling battery, albeit always having a constant flow rate through the evaporator, as the flow rate through the evaporator is at any moment integrated by means of the storage tank.

The new refrigerating/chilling unit makes it possible to use the free-cooling battery at variable flow rate with all the inherent advantages, without, however, this adversely affecting the life of the refrigerating circuit, and in particular of the compressor or compressors of the latter.

The invention will be described in the following in greater detail with reference to an exemplary unrestrictive embodiment shown in the attached drawings, in which.

Figure 1:
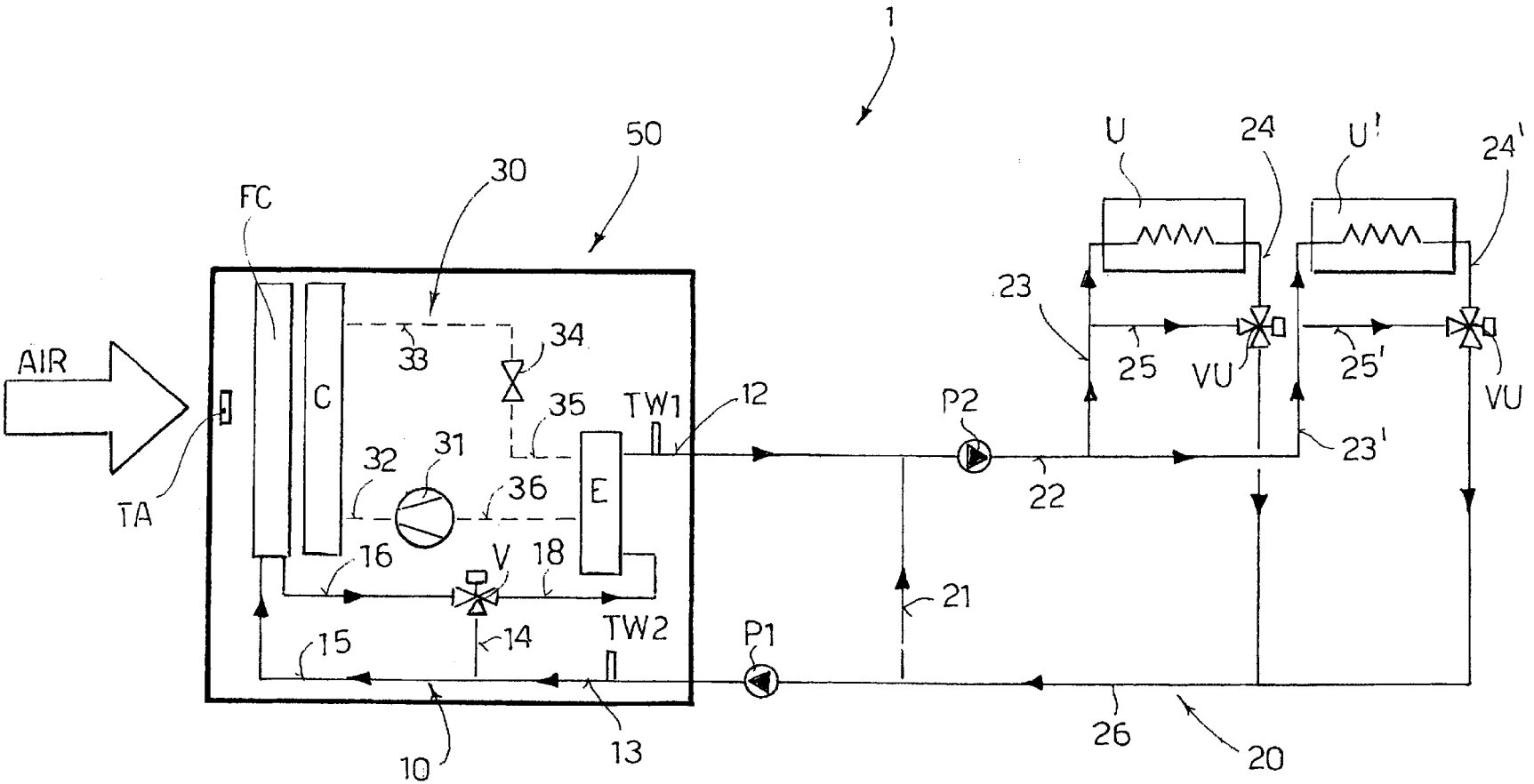
FIG. 1 PRIOR ART
FIG. 1 is a schematic drawing of a prior art free-cooling refrigerating/chilling system.
Figure 2:
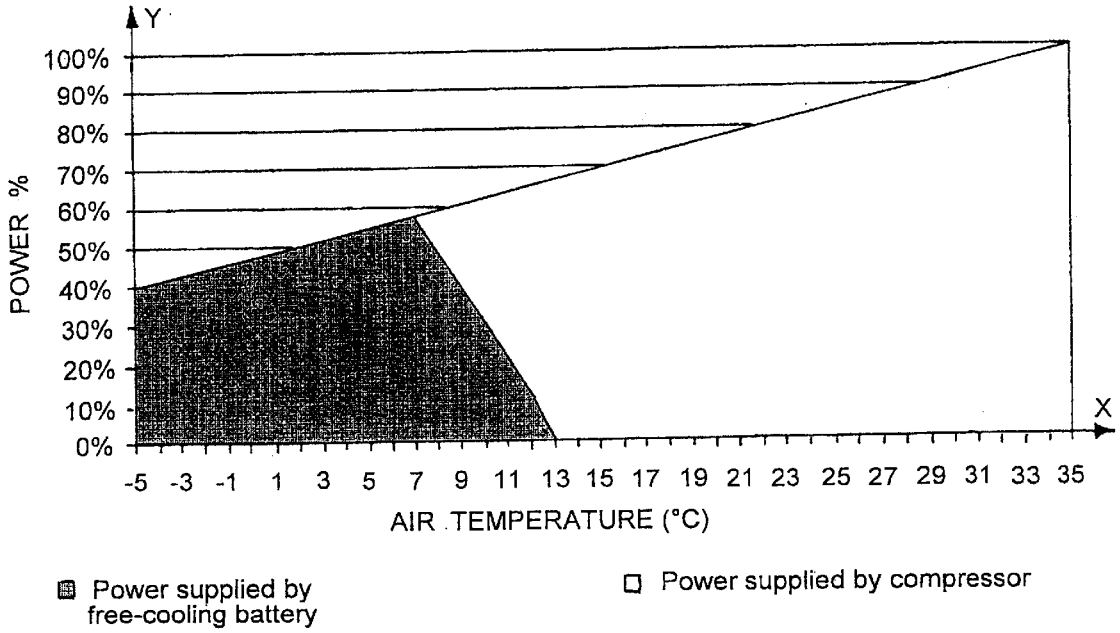
FIG. 2 is a diagram illustrating the difference of yield in the system shown in FIG. 1 for two groups of user's appliances set in parallel, as a function of the type of control; air temperatures are drawn on x-axis; percent power output (yield) is drawn on y-axis.

FIGS. 1 and 2 have been described above in the explanation of the prior art and will not be further described herein.

Figure 3:
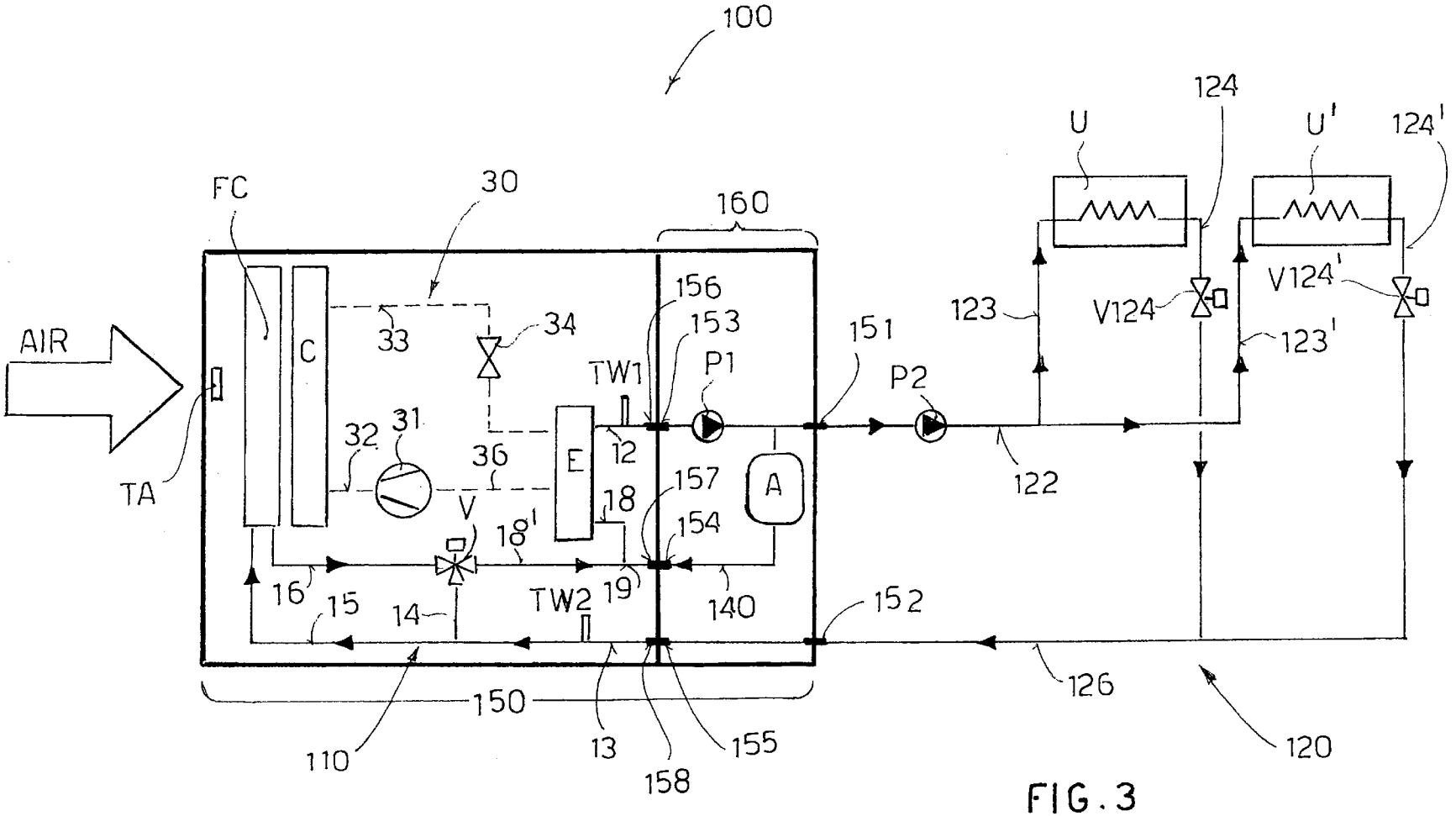
FIG. 3 shows a system according to the invention comprising a chilling unit according to the invention.

A new system comprising a new refrigerating/chilling unit will now be described with reference to FIG. 3. The system is designated as a whole with the reference number 100 and, as far as possible, the parts thereof corresponding to parts of the system of FIG. 1 bear the same reference numbers.

A user's circuit 120 requiring a variable flow rate comprises a variable flow rate delivery pump P2 on a delivery line 122. Inlet lines 123, 123' to user's appliances (or terminals or batteries) U, U' are branched in parallel to one another from the delivery line. Outlet lines 124, 124' from user's appliances are controlled by two-way valves V124, V124' and are connected to a return line 126. The disconnection line designated by 21 in the circuit of FIG. 1 is not present in the case.

The user's circuit 120 is connected to a new refrigerating/chilling unit 150.

The chilling unit 150 comprises a refrigerating circuit 30 and a primary circuit 110. The refrigerating circuit 30 corresponds to the one previously described with reference to FIG. 1, i.e. it comprises a compressor 31, a condenser C, an expansion valve 34, and an evaporator E, and the lines between these (indicated by dash lines).

The primary circuit 110 comprises an inlet line 15 into, and an outlet line 16 from, a free-cooling battery FC, a return line 13, a bypass line 14 to a three-way valve V, a line 18' and a line 18 entering the evaporator. It further comprises a bypass line 140 extending between an outlet line 12 from the evaporator and the inlet line 18 to the evaporator. Mounted on the bypass line 140 is a storage tank or accumulator A of a per-se known type, which is able to supply a flow rate of between 0% and 100% of the maximum flow rate of the system. A circulation pump P1 of the primary circuit is preferably mounted on the outlet line from the evaporator between the evaporator and the bypass line. Reference TA is an air temperature probe sensing air temperature upstream of the free-cooling battery FC; reference TW2 is a water temperature probe sensing water temperature on line 13; and reference TW1 is a water temperature probe sensing water temperature on line 12.

In the system 100, a flow leaving the user's appliances or batteries is sent to the free-cooling battery through lines 126, 13, 15, exits the free-cooling battery through line 16 and line 18' (or else, as an alternative to the free-cooling battery, the liquid from the user's batteries flows through the lines 13, 14, 18'). At a node 19, the flow from 18' is integrated with an additional flow coming from the storage tank A through bypass line 140. The storage tank supplies an integration of flow so as to keep the flow rate constant in the line 18. In this way, the evaporator is fed at a constant flow rate thanks to storage tank A and line 140. In particular, if the entire flow of the system is made to circulate in the user's circuit with pump P2, the entire flow will circulate through the free-cooling battery FC and will return to the evaporator without the storage tank intervening. At 75% of the load, the flow rate of the system and that of the free-cooling battery become 40%, with all the thermal benefits previously described, but the flow rate to the evaporator is always 100% because the storage tank ensures integration of the remaining 60%. At 50% of the load, the flow rate of the system and that of the free-cooling battery become 20%, but the flow rate to the evaporator always remains constant at 100% thanks to the storage tank. In this way, it is possible to separate hydraulically the free-cooling battery from the evaporator, whilst still maintaining an enbloc or self-contained scheme of the system (refrigerator and free-cooling battery in a single unit).

Figure 4:
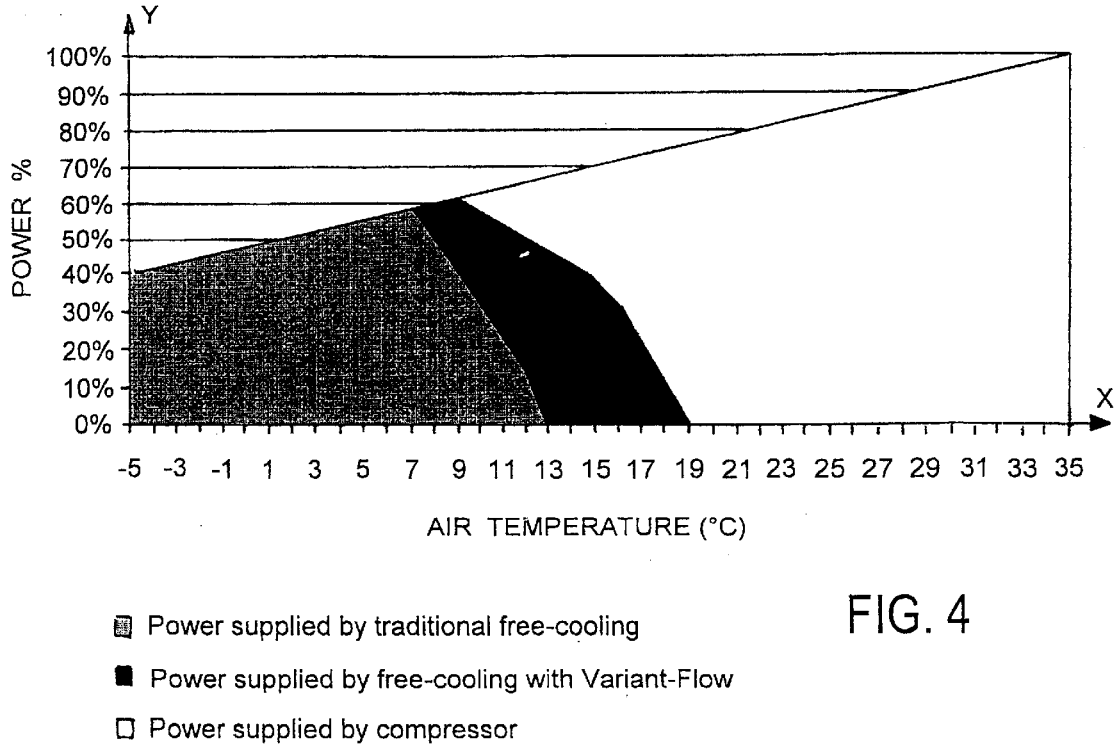
FIG. 4 shows the yield pattern of the free-cooling battery of the system shown in FIG. 3 in a graph similar to the one shown in FIG. 2 and has air temperatures drawn on the x-axis and percent power output (yield) drawn on y-axis.

The advantages are evident from the graph of FIG. 4. Here the free-cooling yield for a traditional system is indicated by the grey area in the diagram. The black area shows the greater output from the free-cooling battery in the new system as compared to the traditional system. The white area shows the output from the compressors.

The chilling unit referenced 150 may be supplied as a single unit comprising the refrigerating circuit 30 and the primary circuit 110, including the free-cooling battery, the inlet lines to and the outlet lines from the free-cooling battery, the three-way valve V and the lines 14, 13, 18', the inlet line 18 to and the outlet line 12 from the evaporator, the circulation pump P1 of the primary circuit, and the bypass line 140 with the storage tank A. In this case, the self-contained unit 150 will comprise two connection terminals 151 and 152 for the secondary, or user's circuit. Note that a sub-unit or auxiliary unit 160 can be provided, comprising part of the output line 12 from the evaporator, the pump P1, the bypass line 140, and the storage tank A, and may be arranged within a same casing as the remaining part of the chilling unit, or else externally to said casing for reasons of overall dimensions.

The sub-unit 160 may be supplied as an individual or self-contained unit for retrofitting existing systems; in this case unit 160 has pipe fittings or unions 153, 154, 155 for connection to an existing chiller 50 (adapted with a line length joined to node 19 and pipe fittings 156, 157, 158), and two pipe fittings or unions 151, 152 on the other side for connection to the user's circuit.

What is claimed is:

1. A chilling unit for a cooling system for cooling a user's terminal or battery, said unit including a refrigerating circuit (30) comprising an evaporator (E), a compressor, a condenser battery (C), and an expansion valve, and connection lines (36, 32, 33), and a primary circuit comprising an outlet line (12) from the evaporator, a return line (13) from the user's terminal, an inlet line (18) to the evaporator, a free-cooling battery (FC), an inlet line (15) to the free-cooling battery, an outlet line (16) from the free-cooling battery, a bypass line (14) for bypassing the free-cooling battery, a three-way valve (V) connected to the outlet line (16) from the free-cooling battery, the bypass line (14), and the inlet line (18) to the evaporator, a pump (P1) of the primary circuit, characterized in that it further comprises a bypass line (140) between the outlet line (12) from the evaporator and the inlet line (18) to the evaporator, and a storage tank (A) on said bypass line.

2. A unit according to claim 1, characterized in that the pump (P1) of the primary circuit is mounted on the outlet line (12) from the evaporator.

3. A unit according to claim 1, made as a self-contained unit having unions (151, 152) for connection to a user's circuit (120).

4. A unit according to claim 1, in which a sub-unit (160), comprising the circulation pump (P1) of the primary circuit, a length of outlet line (12) from the evaporator, the bypass line (140), and the storage tank (A), is externally applied to an assembly comprising the other members of the chilling unit.

5. An auxiliary unit for a cooling system for a user's terminal or battery, said system comprising a chilling unit including a refrigerating circuit (30) having an evaporator (E), a compressor (31), a condenser battery (C), an expansion valve (34), and a primary circuit comprising an outlet line portion (12) from the evaporator, an inlet line portion (18) to the evaporator, a free-cooling battery (FC) connected between an inlet line (15) to the free-cooling battery and an output line (16) from the free-cooling battery, and a bypass line (14) for bypassing the free-cooling battery, said auxiliary unit (160) being characterized in that it comprises a section of outlet line (12) from the evaporator, a pump (P1) of the primary circuit thereon, a bypass line (140) between outlet from and inlet to the evaporator, a storage tank (A) on said bypass line, and in that it is made as a self-contained unit (160) with means (151, 152, 153, 154, 155) for applying to a system.

6. A refrigerating system for a user's appliance or terminal, comprising a refrigerating unit (150) according to claim 1, further comprising at least one inlet line (123; 123') to the user's appliance, an outlet line (124; 124') from the user's appliance, and a feed pump (P2) for feeding the user's appliance, said feed pump, operating with a variable flow rate on the inlet line of the user's appliance.

7. In a refrigerating system for cooling a user's terminal or battery said system operating with variable flow rate through the user's appliance and having a primary circuit with free-cooling battery, a process for allowing a variable flow rate through the primary circuit, characterized in that the variable outlet flow rate from the user's terminal is passed through the free-cooling battery and, before being sent to an evaporator (E) is integrated with a flow coming from a storage tank (A) so as to make the evaporator (E) operate at a constant flow rate.

8. A process according to claim 7, characterized in that the storage tank or accumulator (A) is fed by a line branching from the outlet line (12) of the evaporator.

* * * * *